United States Patent [19]

Scerbo et al.

[11] Patent Number: 4,781,102

[45] Date of Patent: Nov. 1, 1988

[54] LOCKING, BEARING AND ACTUATING APPARATUS

[75] Inventors: Joseph E. Scerbo; Roy B. Johnson, both of York, Pa.

[73] Assignee: York Industries, Inc., York, Pa.

[21] Appl. No.: 40,712

[22] Filed: Apr. 20, 1987

Related U.S. Application Data

[60] Continuation of Ser. No. 740,479, Jun. 3, 1985, abandoned, which is a division of Ser. No. 333,249, Nov. 3, 1981, Pat. No. 4,534,269.

[51] Int. Cl.[4] ..... F15B 15/26

[52] U.S. Cl. ..... 91/41; 91/44; 91/45; 92/24; 92/27; 92/28

[58] Field of Search ..... 91/44, 45, 437, 41; 92/24, 27, 28

[56] References Cited

U.S. PATENT DOCUMENTS

| | | | |
|---|---|---|---|
| 2,323,731 | 7/1943 | Shetzline | 92/28 |
| 2,532,768 | 12/1950 | Halward | 92/27 |
| 3,150,571 | 9/1964 | Frassetto | 92/53 |
| 3,176,590 | 4/1965 | Uhtenwoldt | 91/44 |
| 3,707,629 | 12/1972 | Colsten | 91/45 |
| 3,889,576 | 6/1975 | Sheffer | 92/27 |
| 4,073,217 | 2/1978 | Colin | 91/44 |
| 4,116,113 | 9/1978 | Leclerc | 91/44 |

FOREIGN PATENT DOCUMENTS

| | | | |
|---|---|---|---|
| 289228 | 3/1971 | U.S.S.R. | 92/28 |

*Primary Examiner*—Robert E. Garrett
*Assistant Examiner*—Thomas Denion
*Attorney, Agent, or Firm*—James J. Romano, Jr.

[57] ABSTRACT

The apparatus comprise a generally tubular outer element, a generally cylindrical inner element disposed therewithin and sized relative thereto to provide a generally annular operating space therebetween. An intermediate element is disposed in said operating space and is dimensioned relative thereto to create interference fits with said outer and inner elements and prevent relative movement therebetween. Means are provided to introduce pressurized fluid to the respective element interfaces to expand the outer element within the elastic limit thereof to an extent sufficient to release the interference fits and enable relative outer-inner element movement. Re-locking of the outer and inner elements occurs automatically upon depressurization of the fluid and attendant return of the outer element to its unexpanded configuration. Actuating means to effect relative outer and inner element movement upon apparatus unlocking are also provided, and include means to pressurize the fluid. Apparatus locking by direct outer-inner element interefence fit is also disclosed in conjunction with said actuating means.

4 Claims, 7 Drawing Sheets

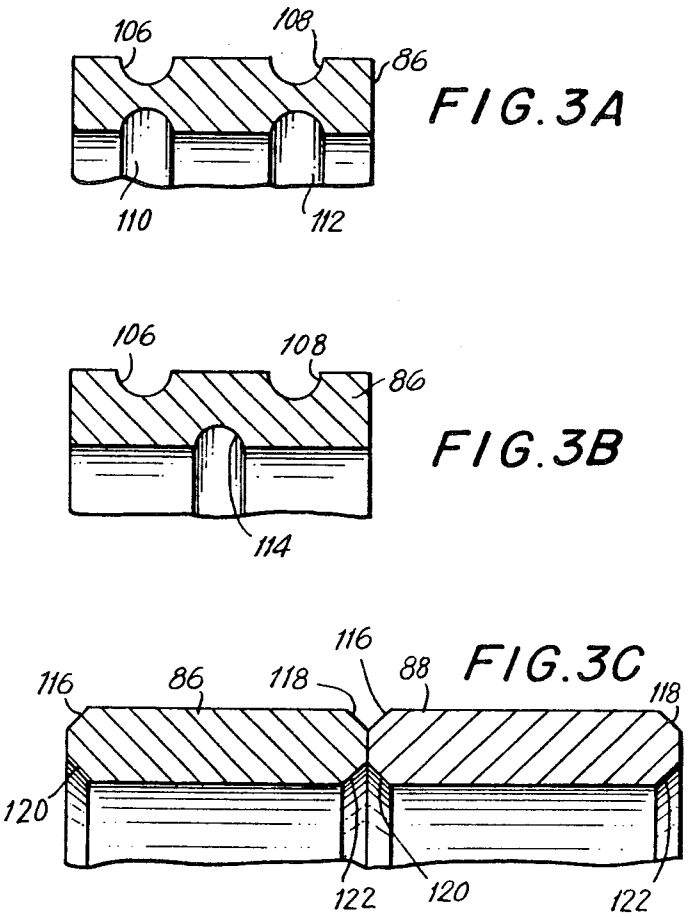
FIG. 3A
86
108
112
106
110
FIG. 3B
86
108
114
106
FIG. 3C
118
122
120
88
116
122
118
86
116
120
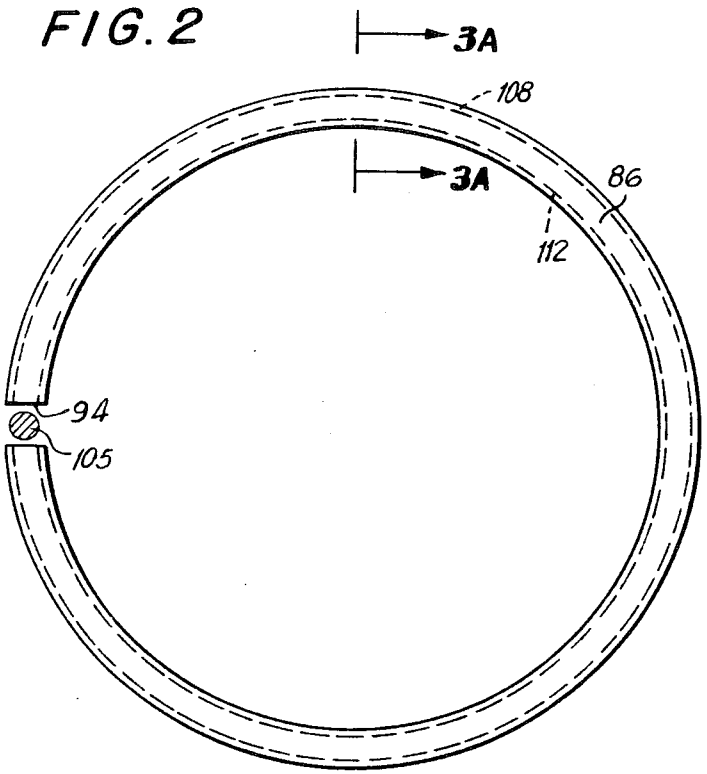
FIG. 2
3A
3A
108
86
112
94
105

LOCKING, BEARING AND ACTUATING APPARATUS

This application is a continuation of copending application Ser. No. 740,479 filed June 3, 1985 now abandoned by Messrs. Joseph E. Scerbo and Roy B. Johnson as a division of application Ser. No. 333,249 filed Nov. 3, 1981 by Messrs. Joseph E. Scerbo and Roy B. Johnson and assigned to the assignee hereof, and now U.S. Pat. No. 4,534,269.

BACKGROUND OF THE INVENTION

1. Field of the Invention

This invention relates to new and improved, infinitely positionable locking and bearing apparatus, and to new and improved fluid-operated actuating apparatus incorporating the same; and the apparatus of this invention embody and provide novel and significant structural and functional improvements and advantages over the similar apparatus of U.S. Pat. No. 3,150,571, commonly owned.

2. Description of The Prior Art

Although apparatus similar to those disclosed in this application are disclosed in commonly owned U.S. Pat. No. 3,150,571, which United States Patent represents the most relevant prior art known to applicants, it has nonetheless been determined in accordance with the teachings of this invention that certain structural and functional aspects of those prior art apparatus are less than optimal, and that novel and significant improvements can be made therein. More specifically, it has been determined in accordance with the teachings of this invention that the cost of manufacture, operation, repair and inventory of the prior art apparatus of U.S. Pat. No. 3,150,571—wherein a sleeve element acts directly upon a rod element to prevent relative movement therebetween, and wherein pressurized fluid is introduced between the respective sleeve and rod elements to elastically deform the sleeve element and enable relative sleeve-rod element movement—can each be significantly reduced, while the reliability of operation, the operational life and the range of suitable applications for such prior art apparatus can each be significantly increased.

OBJECTS OF THE INVENTION

It is accordingly, an object of this invention to provide new and improved, fluid-operated infinitely positionable locking and bearing apparatus, and new and improved, fluid-operated actuating apparatus incorporating the same.

Another object of this invention is the provision of apparatus as above of significantly increased operational life and, in certain instances, significantly reduced manufacturing cost.

Another object of this invention is the provision of apparatus as above which may also be used for precisely controlled braking or decceleration between relatively moveable apparatus components.

Another object of this invention is the provision of apparatus as above which may be very readily repaired or overhauled.

Another object of this invention is the provision of locking, bearing and actuating apparatus as above which are operable with a minimum of operating fluid ports, and which provide a particularly high locking capability per unit apparatus length.

A further object of this invention is the provision of apparatus as above which find a particularly wide range of useful applications under a particularly wide range of operational conditions.

A still further object of this invention is the provision of apparatus as above which require only readily available, relatively low cost components and materials of proven dependability in the fabrication thereof.

SUMMARY OF THE DISCLOSURE

As disclosed herein, the locking and bearing apparatus of our invention comprise a generally tubular outer or sleeve element and a generally cylindrical inner or rod element disposed within said tubular element and providing a generally annular operating space therebetween. A generally annular, intermediate or liner element is disposed in said operating space and comprises fluid passages formed therein in communication with said operating space. The liner is dimensioned relative to the operating space to form interference fits with the sleeve and rod elements to lock the same and prevent relative movement therebetween. To unlock the apparatus, fluid pressurized to a level effective to elastically expand the sleeve element to an extent sufficient to release the interference fits is introduced to the operating space and the liner passages, thereby releasing the lock and permitting relative sleeve element-rod element movement. Reinstitution of the lock is accomplished by simple de-pressurization of the fluid.

The locking, bearing and actuating apparatus of our invention comprise the above-described sleeve, rod and liner elements combined with an actuating piston element which is operable to relatively move the sleeve and rod elements upon release of the lock. In one embodiment of the locking, bearing and actuating apparatus, the rod and actuating piston elements are functionally combined to, in further combination with additional, appropriately valved internal apparatus fluid passages, enable the performance of the locking, unlocking and actuating functions with only two external fluid ports, and provide for maximization of the apparatus locking capability per unit length.

DESCRIPTION OF THE DRAWINGS

The above and other objects and significant advantages of this invention are believed made clear by the following detailed description thereof taken in conjunction with the accompanying drawings wherein:

FIG. 2 is an end view of a liner segment of the apparatus of FIG. 1;

FIG. 3A is a cross sectional view taken generally along line 3A—3A in FIG. 2;

FIG. 3B is a view similar to FIG. 3A showing an alternative configuration of the liner segment of FIG. 2;

FIG. 3C is a view similar to FIG. 3A showing another alternative configuration of the liner segment of FIG. 2 and depicts adjacent liner segments;

DETAILED DESCRIPTION OF THE INVENTION

Figure 1:
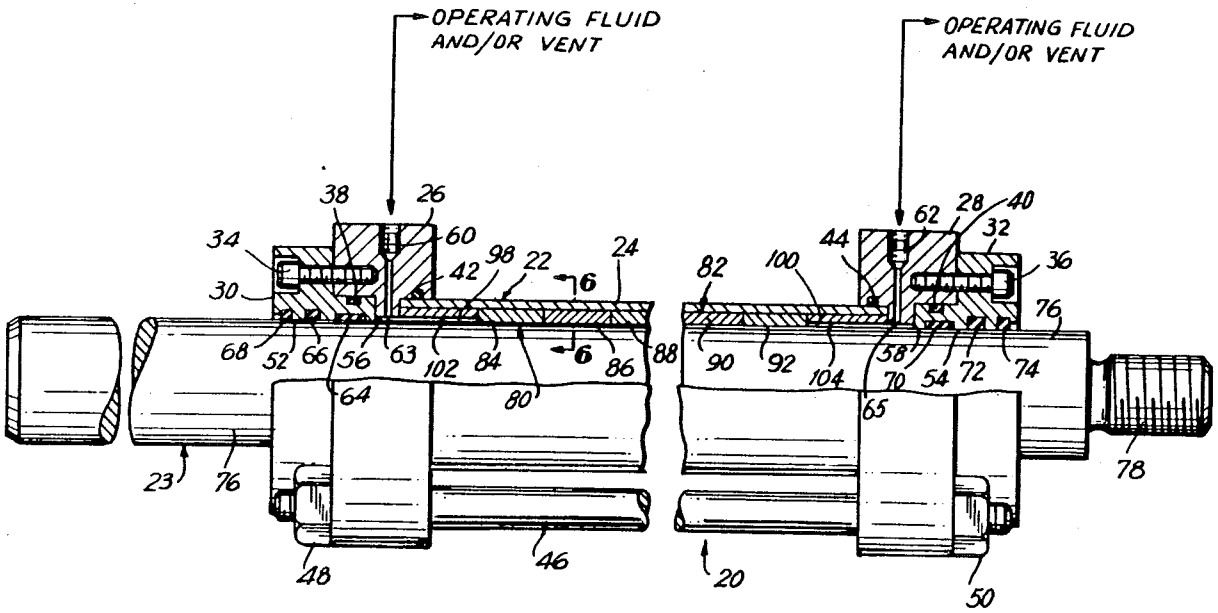
FIG. 1 is a side elevational view partially broken away and in cross section of locking and bearing apparatus constructed and operable in accordance with the teachings of our invention.

Referring now to FIG. 1, new and improved infinitely positionable locking and bearing apparatus constructed and operable in accordance with the teachings of our invention are indicated generally at 20; it being understood that the apparatus 20 are generally similar in configuration and function to those disclosed in U.S. Pat. No. 3,150,571, the disclosure of which is hereby incorporated by reference herein.

The apparatus 20 comprise relatively movable, outer and inner or sleeve and rod elements as indicated generally at 22 and 23, respectively. In the embodiment of FIG. 1, sleeve element 22 includes a tubular sleeve 24, the respective extremities of which are mounted as shown in spaced retainers 26 and 28; while generally cylindrical glands 30 and 32 are respectively interfitted with, and secured to, the retainers 26 and 28 by arrays of spaced attachment bolts, only two of which are shown as indicated at 34 and 36. Seals are indicated at 38 and 40, and are respectively disposed as shown between the retainer 26 and gland 30, and between the retainer 28 and gland 32, to insure fluid-tight seals therebetween. Sleeve seals are indicated at 42 and 44 and are respectively disposed as shown between sleeve 24 and retainers 26 and 28 for like purpose. An array of spaced tie rod and attachment nut assemblies, only one of which is shown as indicated at 46 for the tie rod, and 48 and 50 for the attachment nuts is provided to assemble sleeve element 22 by forcefully securing, to a readily adjustable extent for purposes described in detail hereinbelow, the sleeve 24 between the respective retainers 26 and 28.

Further included in sleeve element 22 are aligned bores of like dimension which are formed as indicated at 52, 54, 56 and 58 in glands 30 and 32, and retainers 26 and 28, respectively. Operating fluid ports are indicated at 60 and 62 and are formed as shown in retainers 26 and 28 to respectively extend therethrough into communication with somewhat enlarged portions 63 and 65 of the retainer bores 56 and 58. Suitable sources of operating fluid and/or suitable vent means, not shown, are connected as indicated to each of the ports 60 and 62. Alternatively, only a single operating fluid port need by provided; although the use of two operating fluid ports as depicted renders connection of the apparatus 20 to the operating fluid source more convenient, and enables circulation of the operating fluid through the apparatus for removal of possible solid contaminants and/or cooling of the apparatus as described in greater detail hereinbelow. Rod wear ring, rod seal and rod scraper elements are indicated at 64, 66 and 68, and are respectively disposed as shown in gland 30; while like elements, as indicated at 70, 72 and 74, are respectively disposed as shown in gland 32.

The rod element 23 comprises a rod 76 which extends as shown longitudinally of the sleeve element 22 through bores 52, 56, 58 and 54 in close fitting, yet readily relatively movable, relationship therewith. Although depicted as of solid configuration, the rod 76 may alternatively be tubular for purposes described in greater detail hereinbelow. As shown, the diameter of rod 76 is less than the inner diameter of sleeve 24, thus providing an annular operating space therebetween. Rod 76 includes an effective end 78 which may be connected in virtually any manner to virtually any mechanism or support for virtually any useful purpose, again as described in greater detail hereinbelow.

An intermediate element is indicated generally at 80 and comprises a tubular liner 82 which, as representatively depicted in FIG. 1, includes liner segments 84, 86, 88 and 90 and 92 sequentially disposed as shown in the operating space between rod 76 and the inner surface of sleeve 24 to surround the former. The respective liner segments are of uniform thickness, and each of the liner segments, for example segment 86 as seen in FIG. 2, comprises a discontinuity 94; it being understood that assembly of the liner segments over rod 76 includes the alignment of the respective segment discontinuities 94 to provide an operating fluid passage which extends longitudinally of the liner 82 and is coextensive therewith.

Tubular spacers of lengths which are predetermined in accordance with the operational characteristics of the apparatus 20 as described in greater detail hereinbelow, are indicated at 98 and 100, and are respectively disposed as shown between retainer 26 and liner segment 84, and between liner segment 92 and retainer 28. Each of the spacers 98 and 100 also includes a discontinuity, not shown, and is of significantly greater inner diameter than the respective liner segments, thereby providing annular spaces 102 and 104 between the respective inner surfaces of the spacers and the outer surface of the rod and insuring that the spacers in no way interfere with relative movement between the respective sleeve and rod elements 22 and 23. Upon assembly, the respective spacer discontinuities are aligned with the aligned liner segment discontinuities, thus continuing the operating fluid passage.

An anti-rotation rod of lesser thickness than the liner segments is indicated at 105 in FIG. 2 and extends through the respective, aligned liner segment and spacer discontinuities coextensively thereof to prevent relative rotation therebetween and thus preserve the integrity of the operating fluid passage. If desired, the ends of the anti-rotation rod 105 may be extended, with longitudinal clearance, into suitable apertures, not shown provided therefor in the relevant faces of the retainers 26 and 28 to thereby prevent rotation of the liner segments relative to the sleeve 24.

With the sleeve element 22 and rod element 23 configured as described, it is believed clear that an operating fluid passage will be provided to extend generally longitudinally of the apparatus 20 and internally connect operating fluid ports 60 and 62; with said passage comprising, as seen from left to right in FIG. 1, enlarged bore portion 56 in retainer 26, annular space 102 and/or the discontinuity in spacer 98, the aligned discontinuities in the liner elements, the aligned discontinuity in spacer 100 and/or annular space 104, and the enlarged bore portion 58 in retainer 28.

In addition to the generally longitudinally extending operating fluid passage provided as described above, it may be understood that generally circumferentially extending, internal operating fluid passages are also provided. More specifically and as seen in FIGS. 2 and 3A, these circumferentially extending operating fluid passages may take the form of spaced, generally semicircular grooves 106 and 108 formed as shown in the outer surface of each of the liner segments, for example 86 as depicted, and like grooves 110 and 112 formed as shown in like manner in the inner surface of each of said segments. Since, as made clear by FIG. 2, each of these grooves communicates with segment discontinuity 94, and thus with the generally longitudinally extending operating fluid passage as a whole, it will be clear that free flow of the operating fluid therebetween will be enabled. Alternatively, and as seen in FIG. 3B, grooves 110 and 112 of FIG. 3A may be replaced by a single, like groove 114 disposed as shown generally centrally of the inner surface of the liner segment. As another alternative, the respective edges of each of the liner segments may be bevelled, as indicated at 116, 118, 120 and 122 for liner segments 86 and 88 in FIG. 3C, thus providing generally triangularly shaped operating fluid passages to extend generally circumferentially of the liner segments at the respective junctures thereof, and each of which passages also freely communicates with the respective segment discontinuities.

Figure 4:
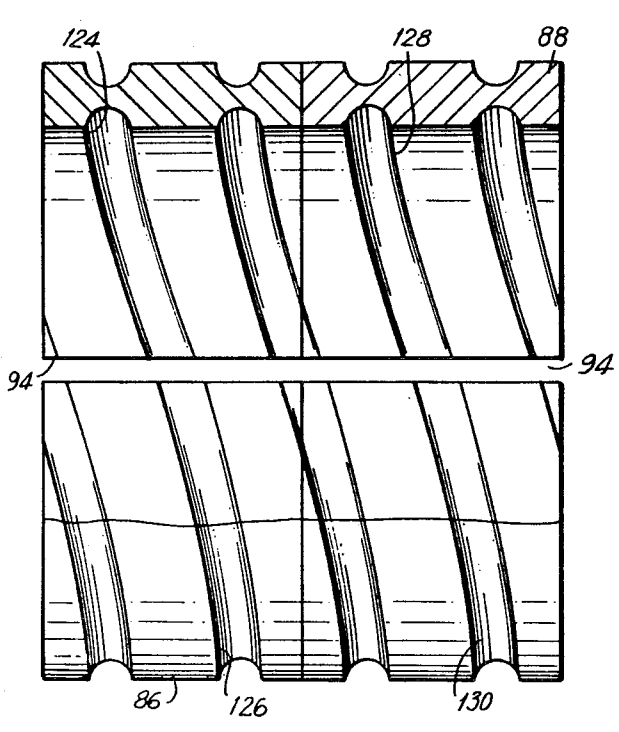
FIG. 4 is an elevational view of two adjacent liner segments partially broken away and in cross section and showing another alternative configuration of the liner segment of FIG. 2.

As another alternative regarding liner segment groove configuration, portions of generally helical grooves as indicated at 124, 126, 128 and 130 on liner segments 86 and 88 in FIG. 4 may be formed in both the inner and outer surfaces of all the respective liner segments and arranged to come into alignment upon assembly of the liner 82 of FIG. 1; thereby providing, in combination with the aligned liner segment discontinuities 94, a plurality of operating fluid passages effectively extending both longitudinally and circumferentially of the inner and outer liner surfaces for comprehensive operating fluid distribution thereover. As a further alternative, intersecting generally longitudinally and circumferentially grooves may be uniformly formed in the inner and outer surfaces of all of the liner segments, as respectively indicated at 132, 134, 136, 138, 140, 142, 144 and 146 for liner segments 86 and 88 in FIG. 5; with grooves 134, 138, 142 and 146 arranged to come into alignment as shown upon assembly of the liner 82 of FIG. 1 to thereby provide a plurality of additional, generally longitudinally extending operating fluid passages coextensive with the liner 82. As a result, and since all of these additional operating fluid passages, as well as the aligned liner segment discontinuities 94, are in communication with all of the generally circumferentially extending grooves, it should be clear that even more comprehensive distribution of the operating fluid over both the inner and outer surfaces of the liner 82 is assured by the liner segment groove configurations of FIG. 5. Although not shown, it may be understood that the liner segment groove configurations of, for example, FIGS. 4 and 5 may be combined to ever further increase the level of operating fluid distribution over the inner and outer liner segment.

Figure 5:
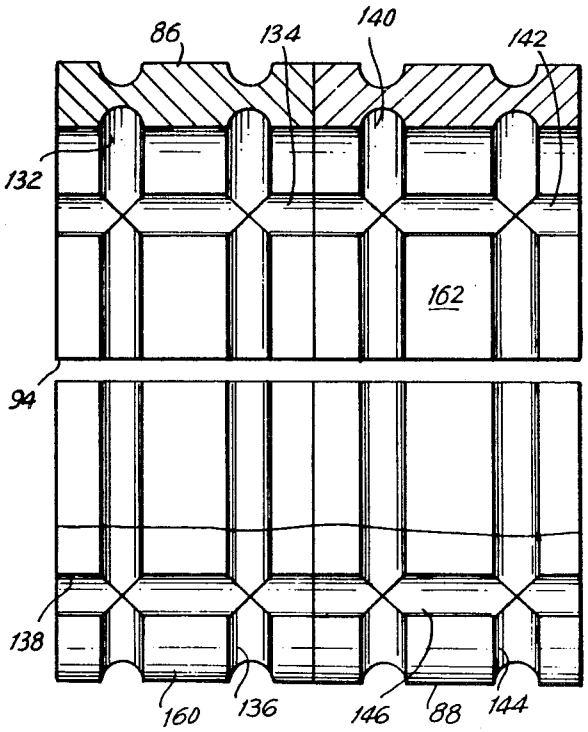
FIG. 5 is an elevational view of two adjacent liner segments partially broken away and in cross section and showing another alternative configuration of the liner segment of FIG. 2.
Figure 6:
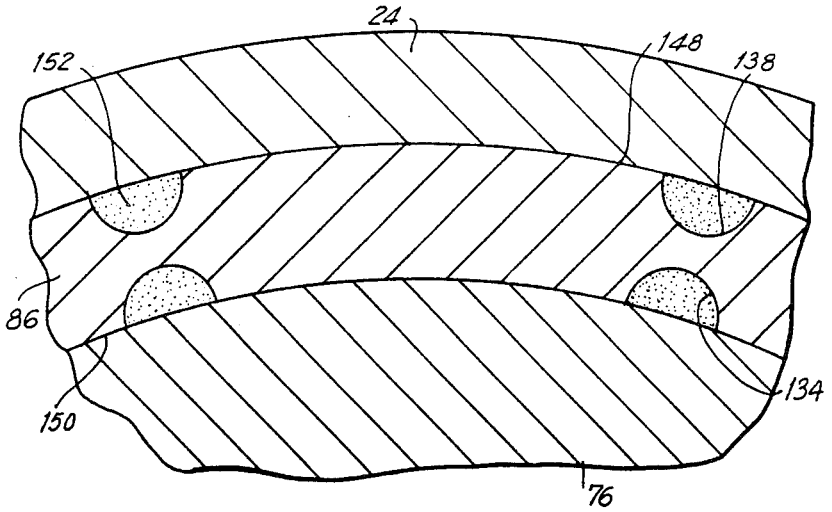
FIG. 6 is an enlarged cross sectional view taken generally along line 6—6 in FIG. 1 and depicts the apparatus of FIG. 1 in the locked condition thereof.

Referring now to the essential dimensional characteristics and operation of the apparatus 20 of FIG. 1, and assuming the respective liner segments to embody the groove configurations of FIG. 5, it may be understood that the inner diameter of sleeve 24, the thickness of liner 82, and the outer diameter of rod 76 are respectively carefully predetermined to insure that interference fits will exist between the inner surface of the sleeve and the ungrooved portions of the outer surface of the liner, and between the ungrooved portions of the inner surface of the liner and the outer surface of the rod. This is to say that the inner diameter of the sleeve 22 is predetermined to be less than the outer diameter of the combined rod 76 and liner 82. Under these circumstances, a particularly secure mechanical connection between the sleeve 24 and rod 76 will be effected through the liner to very forcefully lock the rod relative to the sleeve and render relative movement between the sleeve element 22 and the rod element 23 virtually impossible in the absence of an overload. This locked condition of the apparatus 20 is illustrated in FIG. 6 wherein representative, sleeve-liner interference-fitted contacting surfaces are indicated at 148, and representative liner-rod interference-fitted contacting surfaces are indicated at 150. FIG. 6 also makes clear that, although operating fluid, as indicated at 152 in the liner grooves 138 and 134, may be present in the operating fluid passage(s) throughout the apparatus 20, the same will in no way interfere with the integrity of the apparatus lock.

Figure 7:
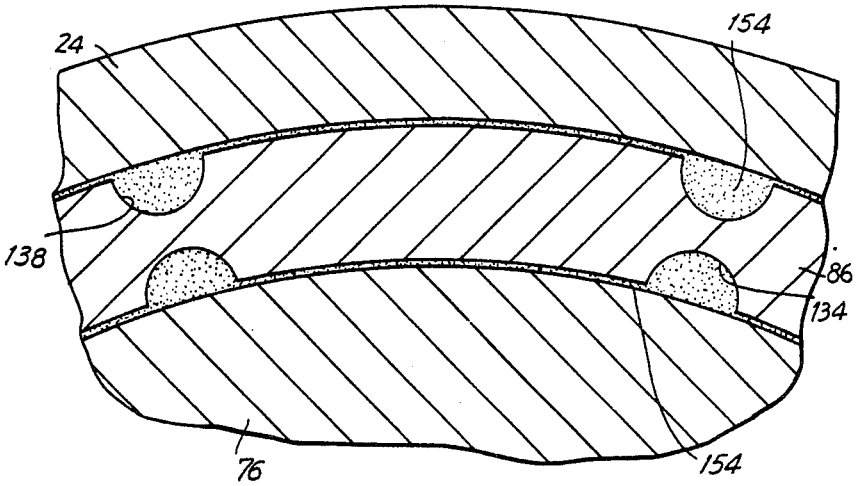
FIG. 7 is a view similar to FIG. 6 and depicts the apparatus of FIG. 1 in the unlocked condition thereof.

Unlocking of the apparatus 20 to enable relative movement between the sleeve element 22 and the rod element 23 is readily accomplished by the pressurization through ports 60 and/or 62 of the operating fluid in the internal fluid passage(s) to a level which has been predetermined to be effective to radially expand the sleeve 24 outwardly well within the elastic limits of the sleeve material, but nonetheless to an extent sufficient to release the interference fits between the sleeve 24, the liner 82 and the rod 76. More specifically, and as shown in FIG. 7 to a somewhat exaggerated scale for purposes of clarity of illustration, the effectively pressurized operating fluid, as indicated at 154 in FIG. 7, in the respective liner passages and grooves, will cause the radially outward expansion as above of the sleeve 24 relative to the liner 82 and rod 76 with attendant sleeve-liner-rod separation and flow of the pressurized operating fluid as shown into the annular sleeve-liner and liner-rod spaces created by such separation. As a result, relative movement between the sleeve element 22 and the rod element 23 is made readily possible; with the pressurized operating fluid in the spaces between the now essentially free-floating liner 82 (substantially equal but oppositely directed forces will be exerted on the liner by the pressurized operating fluid), and the rod 76 and sleeve 24, respectively, acting in addition as a particularly effective and low friction hydrostatic bearing attendant such movement. Pressure loss through leakage of the pressurized operating fluid is, of course, substantially prevented by the respective sleeve and rod seals. Since, as a practical matter, the respective sleeve end portions cannot expand radially outwardly as described within the retainers 26 and 28, or in the areas immediately adjacent thereto, it will be clear that spacers 102 and 104 are provided to insure that unlocking of the apparatus 20 can be accomplished as described.

Reinstitution of the lock between sleeve element 22 and rod element 23 is readily accomplished by the depressurization of the operating fluid, as by suitable valving or venting through ports 60 and/or 62, whereupon the sleeve 24, which has not been expanded beyond its elastic limits, will inherently and immediately elastically return to its initial configuration to return the apparatus 20 to the interference-fitted locked condition of FIG. 6; it being understood that the elastic return of the sleeve 24 to its unexpanded condition will be effective to forcefully expel the operating fluid from between the re-contacted sleeve, liner and rod surfaces back into the operating fluid passages and grooves.

Under the above-described operating conditions, it will be understood that the apparatus 20 is essentially "fail-safe," in that any accidental or inadvertent depressurization of the operating fluid with the apparatus unlocked, or any failure of the operating fluid pressurization and/or venting means with apparatus locked, will simply result in the apparatus immediately returning to, or remaining in, as the case may be, the locked condition thereof.

The locking force generated as described by the apparatus 20 to prevent relative movement between the respective rod and sleeve elements 23 and 22, and the level to which the operating fluid must be pressurized to release the lock, will, with a solid rod 76, be determined in large measure by the thickness and modulus of elasticity of the sleeve 24, the extent to which the same is interference-fitted relative to the outer diameter of the combined liner 82 and rod 76, the respective relative lengths of the spacers 102 and 104, the total area of the sleeve 24 against which the pressurized operating fluid can effectively act, and/or by the total areas of respective surface contacts between the sleeve and liner and between the liner and rod. With more specific regard to the latter, and assuming, for example, the respective liner segments to embody the operating fluid groove configurations of FIG. 5, it will be clear that respective liner surface areas, or what might in essence be termed "pads," of liner-sleeve and liner-rod contact will be provided as representatively indicated at 160 and 162 in FIG. 5; whereby the precise predetermination of the locking or load-bearing capacity of the apparatus 20 will include the precise predetermination of the total surface area of the thusly provided areas of surface contact and the multiplication thereof by the precisely predetermined load-bearing capacity per unit area.

Fine tuning of the apparatus 20 under actual assembled and test conditions to precisely achieve a predetermined locking or load-bearing capacity, and to precisely achieve apparatus unlocking at a predetermined operating fluid pressurization level, is readily accomplished by appropriate fine adjustment in the amount of tension on tie rods 46 through change in the torque applied to attachment nuts 48 and 50, with attendant fine adjustment in the amount of axial compression exerted on sleeve 24 by retainers 26 and 28; it being clear that, for example, the greater such axial compression the lesser the extent of the interference fit between the sleeve and the liner and rod, due to the natural tendency of the sleeve to bow slightly outwardly under such axial compression. Accordingly, tightening of the attachment nuts will adjust the apparatus locking force and the level of operating fluid pressurization required for apparatus unlocking downwardly, and vice versa.

By all of the above is believed made clear that selective locking, within the load-bearing capacity of the apparatus 20, of the respective sleeve and rod elements 22 and 23 throughout a virtually infinite range of relative longitudinal and/or angular positions is made readily achievable; with selective change in those relative positions made equally readily achievable through appropriate pressurization of the operating fluid and relative movement of the thusly unlocked sleeve and rod elements taking full advantage, attendant such relative movement, of the hydrostatic bearing provided by the appropriately pressurized operating fluid in the manner described in detail hereinabove with regard to FIG. 7.

As an alternative, or correlative, to locking and unlocking operation of the apparatus 20 as described, it may be understood that the operating fluid may be pressurized to a level which, while sufficient to radially outwardly expand the sleeve 24 to in essence reduce the interference fits between the sleeve and liner 82, and between the liner and rod 76, is nonetheless insufficient to achieve the complete separation between those elements as depicted in FIG. 7. Under these conditions, which cannot be illustrated to meaningfully distinguish from FIG. 6 since sleeve-liner and liner-rod surface contact will still exist, the liner 82 will function in the nature of a friction brake on relative movement between the sleeve element 22 and the rod element 23; with the level of the braking force being generally inversely proportional to the level to which the operating fluid is pressurized. Thus, and with, for example, precise programming of the level of operating fluid pressurization, precisely controlled and, if desired, time or other relevant parameter-variable, deceleration of relative movement between the sleeve and rod elements 22 and 23 of the apparatus 20 can be readily provided. Cooling of the apparatus 20 to remove heat generated by liner-rod friction attendant such usage of the apparatus may be readily achieved by circulation, through use of two operating fluid ports as seen at 60 and 62 in FIG. 1, of the appropriately pressurized operating fluid at an appropriate flow rate through the respective internal operating fluid passages of the liner; and/or by the addition of suitable apparatus cooling means, not shown, taking for example the form of cooling water jacket means or the like formed to surround the sleeve element 24. Also, such usage of the apparatus 20 would preferably dictate the use of liner materials of high thermal conductivity and high resistance to surface wear as described in greater detail hereinbelow.

Figure 8:
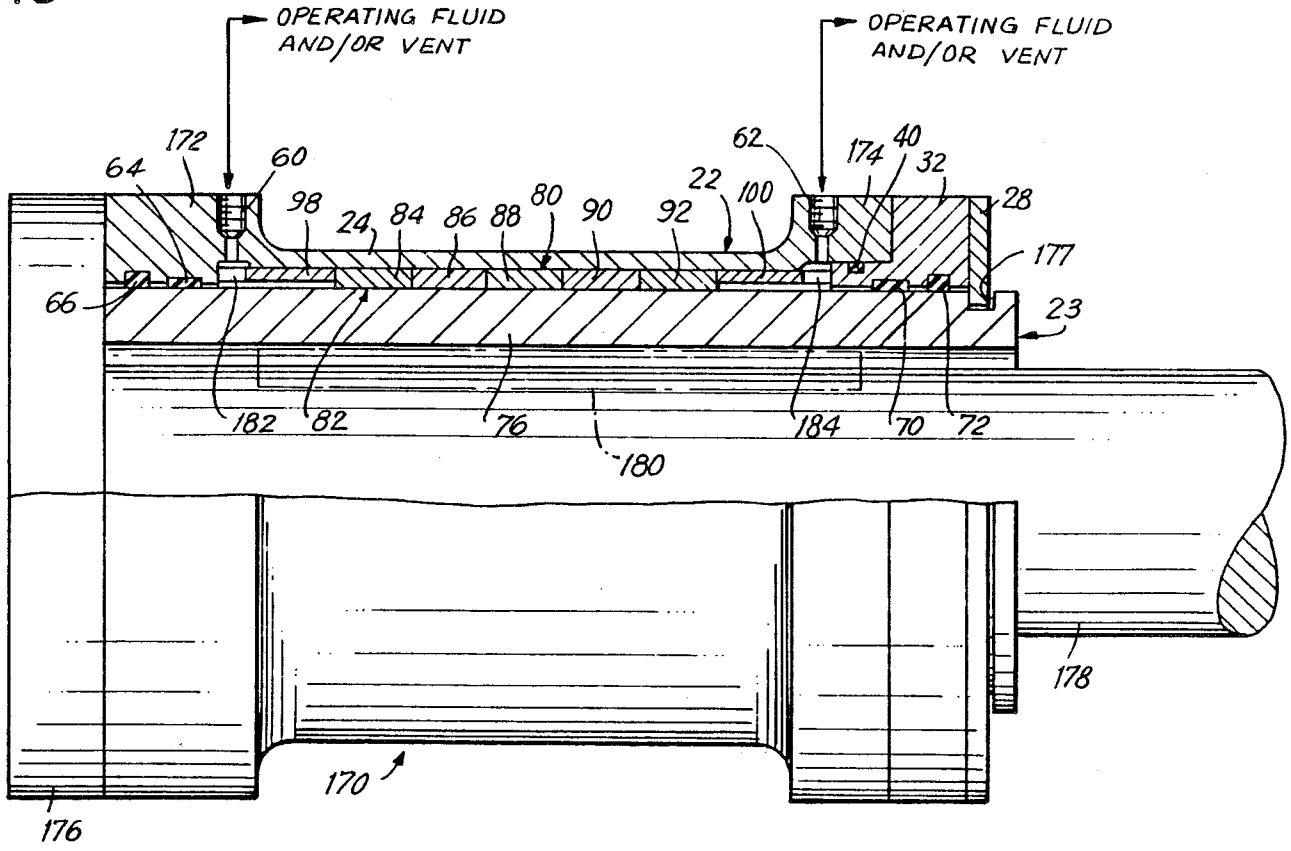
FIG. 8 is a side elevational view partially broken away and in cross section of locking and bearing apparatus constructed and operative in accordance with the teachings of our invention and particularly adapted for use with relatively rotatable elements.

FIG. 8 depicts the application of the teachings of applicants' invention to apparatus as generally indicated at 170 wherein movement between the respective sleeve and rod elements is limited to relative rotation. More specifically, and as seen in FIG. 8 wherein like components bear the same identifying numerals as utilized hereinabove with regard to FIG. 1, the sleeve element 22 comprises tubular sleeve 24 which includes enlarged end portions 172 and 174; the former of which is attached as indicated by non-illustrated attachment bolts to a solid, generally cylindrical end 176, and the latter of which is attached as indicated by non-illustrated attachment bolts to gland 32 and retainer 28. Seal 40 is disposed as shown between sleeve end portion 174 and gland 32 to prevent fluid leakage therebetween. The operating fluid ports 60 and 62 extend respectively as shown through the enlarged sleeve end portions 172 and 174.

The rod element 23 in the embodiment of FIG. 8 comprises a tubular rod 76 which is disposed for relative rotation in the aligned bores provided therefor in sleeve end portion 172 and gland 32; and relative longitudinal movement of the rod element 23 and the sleeve element 22 is prevented by end cap 176, and by the extension as shown of retainer 28 into a complementally shaped groove 177 formed circumferentially of the rod 76. Rod seals 66 and 72, and rod wear rings 64 and 70 are provided as shown in sleeve end portion 172 and gland 32 to prevent operating fluid leakage between the respective sleeve and rod elements. Further included in rod element 23 is a shaft 178 which is secured to and supported from rod 76 by an array of spaced, internal keys, only one of which is illustrated as indicated at 180.

The intermediate element 80 in the embodiment of FIG. 8 comprises a liner 82 which includes liner segments 84, 86, 88, 90 and 92; and spacers 98 and 100 respectively disposed as shown between liner segment 84 and sleeve end portion 172, and between liner segment 92 and gland 32. Since, in the apparatus 170, the respective operating fluid ports 60 and 62 communicate directly with the spacers 98 and 100, it will be seen that notches as indicated at 182 and 184 in FIG. 8 are provided in the respective outer spacer portions to enable the free communication of the operating fluid therethrough into and through the operating fluid passages which are again provided, as described in detail hereinabove with regard to FIGS. 1 through 7, to extend both longitudinally and circumferentially of the liner 82.

Operation of applicants' invention in the apparatus 170 of FIG. 8 is virtually identical to that described in detail hereinabove with regard to the apparatus 20 of FIG. 1 in providing the capability to selectively lock, by sleeve-liner and liner-rod interference fits, the sleeve element 22 and rod element 23, including shaft 178, in any one of a virtually infinite range of relative angular positions, and to immediately release the same for free, hydrostatic bearing supported relative rotation immediately upon pressurization of the operating fluid to an appropriate level. In addition, and as described in detail hereinabove with regard to apparatus 20 of FIG. 1, precisely controlled braking or deceleration by liner element 80 of relative rotation between sleeve element 22 and rod element 23, including again shaft 178, can also be readily achieved in apparatus 170 through appropriate programming of the level of operating fluid pressurization below that which is effective to separate the respective rod, liner and sleeve elements.

It is possible, however, with regard to the operation of the apparatus 170 of FIG. 8 wherein the rod 76 is tubular rather than solid that, depending upon the relative thicknesses of the rod and sleeve walls (excluding, of course, the enlarged sleeve end portions) and the relationship between the respective sleeve and rod moduli of elasticity, radially inward contraction of the rod may occur concomitantly with radially outward expansion of the sleeve in response to pressurization of the operating fluid to the predetermined apparatus unlock level. Under such conditions, the respective sleeve, liner and rod elements would nonetheless assume the basic, separated relative positions of FIG. 7; but it will be clear that the factor of rod contraction would have to be included in those considered for precise determination of the essential operational parameters of the apparatus.

Figure 9:
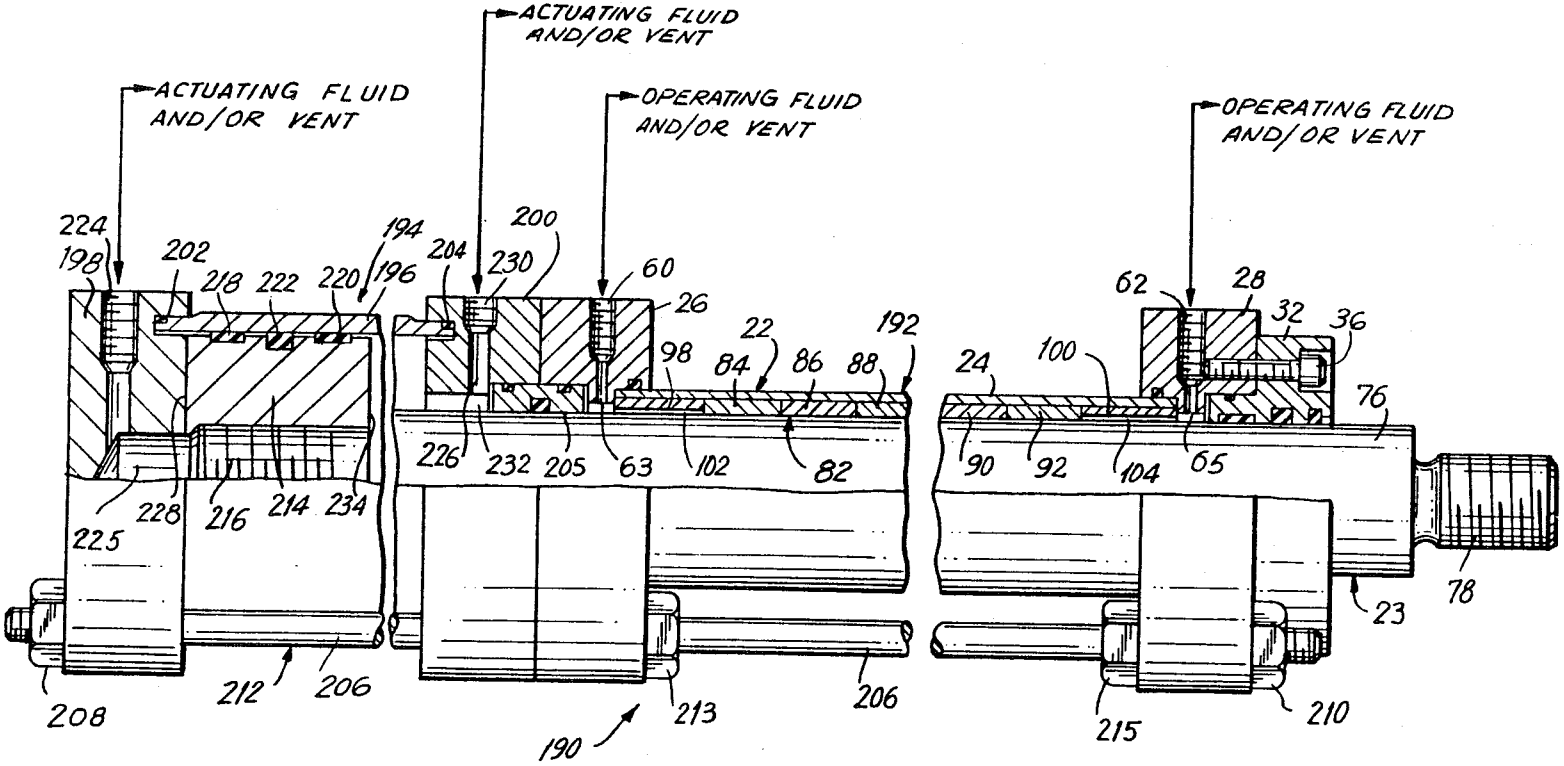
FIG. 9 is a side elevational view partially broken away and in cross section of actuating apparatus constructed and operative in accordance with the teachings of our invention and further including the locking and bearing apparatus of that invention.

FIG. 9 depicts the application of the teachings of applicants' invention to combined, fluid-operated actuating, locking and bearing apparatus as indicated therein generally at 190; and which include a locking and bearing section as indicated generally at 192, and an actuating cylinder section as indicated generally at 194. Locking and bearing section 192 is of essentially the same construction and manner of operation as apparatus 20 of FIG. 1 and thus need not again be described in detail. Like reference numerals are used to describe like components for the apparatus 20 of FIG. 1 and for section 192 of apparatus 190 of FIG. 9.

Actuating cylinder section 194 of the apparatus 190 of FIG. 9 comprises a tubular cylinder 196 which extends as shown between arcuate mounting grooves provided therefor in opposed faces of spaced, blind end and rod end caps 198 and 200. Cylinder seals 202 and 204 are provided in the mounting grooves to prevent the leakage of pressurized fluid at the respective cylinder-groove junctures.

The respective actuating cylinder and locking and bearing sections 194 and 192 are assembled and interconnected as shown in the depicted, back-to-back longitudinally aligned manner, to secure a center gland 205 therebetween in matching mounting grooves provided therefor at the interface of rod end cap 200 and retainer 26, by an array of spaced lock tie rods and attachment nut assemblies, only one of which is shown as indicated at 206 for the tie rod and 208 and 210 for the attachment nuts, which extend through aligned bores provided therefor in blind end cap 198, rod end cap 200 and retainers 26 and 28. Additional attachment nuts 213 and 215 are provided on lock tie rod 206 adjacent the opposed interior faces of retainers 26 and 28 for purposes described in detail hereinbelow. Further assemblage of the actuating cylinder section 194 and attachment thereof to the locking and bearing section 192 is provided by an additional array of spaced cylinder tie rod and attachment nut assemblies, only one of the tie rods of which is shown as indicated at 212, which extend through aligned bores provided therefor in blind end cap 198, rod end cap 200 and retainer 26.

With the apparatus 190 of FIG. 9 configured and assembled as described, it will be seen that longitudinally aligned bores will be provided to extend through gland 32, retainer 28, retainer 26, center gland 205 and rod end cap 200, respectively; with rod 76 extending therethrough from locking and bearing section 192 into actuating cylinder section 194. A piston 214 is secured as shown to the actuating cylinder end 216 of rod 76, within cylinder 196, and piston wear rings 218 and 220, and piston seal 222 are respectively carried from the piston 214 to cooperate with cylinder 196 for obvious purpose.

A rod extend port is indicated at 224 and extends as shown through blind end cap 198 into communication with cap chamber 225 which in turn communicates with the outer face 228 of piston 214. A rod retract port is indicated at 230 and communicates as shown through the enlarged bore 232 in rod end cap 200 with the inner face 234 of the piston 214. The respective rod extend and rod retract ports 224 and 230 are connected as indicated to a non-illustrated, suitably valved—as for venting—source of pressurized piston actuating fluid which, for certain applications of the apparatus 190 may be the same source as that utilized to provide the pressurized operating fluid to ports 60 and 62 of the locking and bearing section 192.

In operation, and assuming the apparatus 190 to be in the condition thereof as depicted in FIG. 9 with the piston 214 and rod 76 fully retracted in the actuating cylinder section 194, and the rod 76 fixedly locked as described in detail hereinabove to the sleeve element 22 through liner 82 in the locking and bearing section 192, it will be clear that the concomitant introduction of appropriately pressurized—to an extent sufficient to release the lock—operating fluid through port(s) 60 and/or 62, and of appropriately pressurized—to an extent sufficient to move piston 214 and rod 76 against whatever load, if any, is being imposed on rod end 78—actuating fluid through extend port 224, will result in release of the sleeve-rod element lock in section 192 and the driven movement of the piston 214 and rod 76 to the right as seen in FIG. 9. Of course, once the effective end 78 of the rod has been driven to the desired extended position thereof, depressurization of the operating fluid will be effective to immediately lock the same in the latter, with immediately following depressurization of the actuating fluid functioning to terminate the now no longer necessary extend force as exerted on the rod 76 by piston 214. In like manner, and assuming the rod 76 to be locked in an extended position and driven movement thereof to a less extended or fully retracted position desired, it will be clear that concomitant introduction of appropriately pressurized operating and actuating fluid(s) to ports 60 and/or 62 in locking section 192, and retract port 226 in actuating section 194, respectively, will be fully effective to those ends; whereupon operating and actuating fluid depressurization will again be immediately effective to re-establish the lock. Thus is made clear that selective locking against relative movement of the respective interconnected locking and actuating sections 192 and 194 and the rod 76, throughout a virtually infinite range of relative positions commensurate with the stroke of piston 214 in cylinder 196 is provided by the application of the teachings of applicants' invention in the apparatus 190. 0f course, the thusly provided locking action is equally effective to prevent relative rotation between the rod 76 and sleeve 24.

Fine tuning of the locking and bearing section 192 of the apparatus 190 is accomplished, as described in detail hereinabove with regard to apparatus 20 of FIG. 9, by adjustment in the torque on attachment nut 210 to change the tension exerted on lock tie rod 206. This is accomplished by the loosening of lock nuts 213 and 215, adjustment as desired in the torque on attachment nut 210, and the re-tightening of lock nuts 213 and 215 snugly against the relevant faces of retainers 26 and 28 to in essence "lock in" the adjustment.

Figure 10:
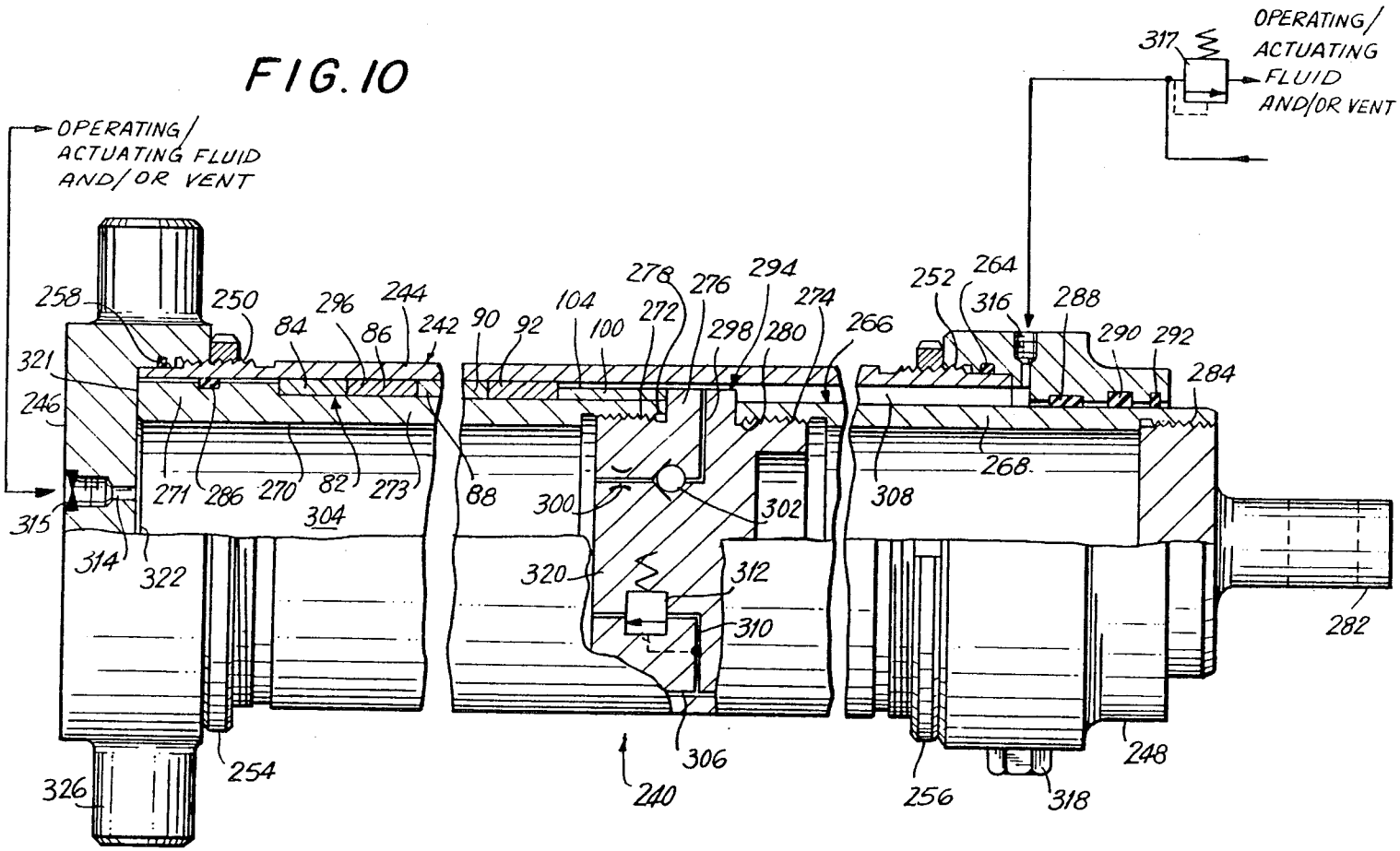
FIG. 10 is a side elevational view partially broken away and in cross section of another embodiment of actuating, locking and bearing apparatus constructed and operative in accordance with the teachings of our invention.

FIG. 10 depicts the application of the teachings of applicants' invention to another combined, fluid-operated actuating, locking and bearing apparatus as indicated therein generally at 240; and wherein the respective actuating and locking and bearing sections are in essence combined to result in more compact apparatus. More specifically, in FIG. 10 the sleeve element is indicated generally at 242 and comprises a cylinder 244, which also functions as the sleeve with regard to apparatus locking and unlocking as heretofore described, and which extends as shown into and between suitable bores provided therefor in a blind end cap 246 and a rod end cap 248. The relevant cylinder and bore surfaces are complementally threaded as indicated at 250 and 252 to secure the cylinder in the blind and rod end caps; and locknuts are provided as indicated at 254 and 256 to secure the cylindercap assembly. Cylinder seals are provided as respectively indicated at 258 and 264 for obvious purpose.

A rod element is indicated generally at 266, and comprises a tubular rod 268 and a tubular piston 270 which includes an enlarged piston head 271 and a tube-like portion 273 which, in the embodiment of FIG. 10, functions as the rod with regard to apparatus locking and unlocking as heretofore described.

The rod 268 and piston 270 are interconnected as shown at complementally threaded areas 272 and 274 by a generally cylindrical connector 276 to form a functionally integral piston-connector-rod assembly. Piston to connector and rod to connector seals are provided for obvious purpose as shown at 278 and 280. A rod end is indicated at 282 and is secured as shown in the open end of rod 268 at complementally threaded areas 284. A piston seal 286 is carried as shown from the piston 270 and cooperates with the inner wall of cylinder 244 to prevent the leakage of pressurized fluid around the piston; while rod wear ring, rod seal and rod scraper 288, 290 and 292 are respectively carried as shown from the rod end cap 252 to cooperate with the outer surface of rod 268 to prevent leakage of pressurized fluid from the apparatus 240.

An intermediate element is indicated generally at 294 and comprises a liner 296 which is configured, dimensioned, disposed and operable relative to cylinder or sleeve 244 and piston portion 273 as heretofore described and which, to those ends, comprises liner segments as again indicated at 84, 86, 88, 90 and 92, and a spacer as again indicated at 100. In the embodiment of FIG. 10, the spacer 100 will be seen to be carried from the piston portion 273 and to be of somewhat lesser outer diameter than the inner diameter of the cylinder or sleeve 244. As a result, the annular space or volume 104 will, in this embodiment, be seen to be provided between the sleeve and the spacer, rather than between the rod and spacer as, for example, in the apparatus 20 of FIG. 1 or the apparatus 190 of FIG. 9.

A pressurized fluid passage 298, including orifice 300 and check valve 302, is provided to extend as shown through connector 276 to communicate, and permit fluid flow only in the direction between, the internal volume or space 304 of piston 270 and the generally annular volumes or spaces 306 and 308 which are respectively formed between the connector 276 and rod 268, and the inner wall of the cylinder or sleeve 244. A pressurized fluid relief passage 310, including relief valve 312, is provided to also extend as shown through connector 276 and further communicate, and permit fluid flow only in the direction between, volumes or spaces 308 and 306, and volume or space 304.

A rod extend port is indicated at 314 and extends as shown through blind end cap 246 into communication with internal piston volume 304. A flow control device is schematically indicated at 315 and is operatively disposed as shown relative to extend port 314. A rod retract port is indicated at 316 and extends as shown through rod end cap 248 into communication with annular volume 308. A pressure relief valve is schematically indicated at 317 and is operatively disposed as shown relative to retract port 316. The respective rod extend and retract ports are connected as indicated to a non-illustrated, suitably valved—as for venting—source of pressurized fluid which, in the apparatus 240, functions as both the actuating and operating fluid as described in detail hereinbelow. A safety fuse or blowout plug is indicated at 318, and is operable to discharge pressurized fluid outside apparatus 240 to prevent excessive pressure build-up in volume 308.

Of particular advantage with regard to the apparatus 240 is the fact that the same are fully operable to perform both the actuating and unlocking functions through use of only two fluid ports, namely the extend port 314 and the retract port 316. Significantly, no additional port(s) are required for apparatus unlocking since, as described in detail hereinbelow, apparatus 240 functions as a pump for the internal development of unlock pressure attendant extension of rod 268. This is accomplished by providing a high ratio between the piston end area of the apparatus, namely the combined areas of connector face 320 and the annular end 321 of piston 271, and the rod end area of the apparatus, namely the cross-sectional area of annular space 308. This ratio may, for example, range between 5:1 to 10:1. The pumping action is achieved by closing off the retract port 316 with relief valve 317 set at apparatus unlock pressure during extension of rod 268. Upon extension of piston 270 and rod 268, the actuating-operating fluid in volume 308 is pressurized to the apparatus unlock pressure, as determined by the setting of relief valve 317, thus automatically unlocking the apparatus 240 and maintaining the same unlocked until piston and rod extension cease. When this occurs, through external venting of the operating-actuating fluid, the pressure in rod end volume 308 is also vented, thus reapplying the apparatus lock. Under these circumstances, it becomes clear that the effective output of the apparatus 240 is equal to actuating-operating fluid pressure as multiplied by the cross-sectional area of rod 268.

More specifically, and taking for example a situation wherein the unlock pressure of the apparatus 240 is 3200 psi, and the piston-rod end area ratio is approximately 8:1, extension of rod 268 can occur with the application of actuating-operating fluid at only approximately 1600 psi to extend port 314. This is made possible by the fact that the pressurized fluid passes freely from piston volume 308 through check valve 302 in connector 276 to in turn pressurize annular spaces 306, 308 and 104, and thus the liner 82; it being clear that as pressure in the liner increases, the apparatus locking force decreases proportionally. Thus, as soon as both the piston volume 304 and the liner 82 are pressurized to approximately 1600 psi, it may be understood that the resultant combination of extend and unlock forces will cause momentary slippage of the sleeve-liner-piston lock with attendant small initial movement of the piston 270 and rod 268 to the right as seen in FIG. 10. As soon as this small initial movement takes place, the pressure in annular spaces 306, 308, and 104, and in the liner 82, will be rapidly increased to the 3200 psi setting oi reliei valve 317 by the above-described apparatus pumping action as provided by the high piston-rod end area ratio. Thus, apparatus unlocking and extension of rod 268 will occur. If rod 268 is being extended against no external load, the pressurization of the actuating-operating fluid at extend port 314 may then be reduced to approximately 400 psi, with the 8:1 piston-rod end area ratio functioning nonetheless to maintain the 3200 psi unlock pressure in the liner 82 and enable rod extension to continue. If rod 268 is being extended against an external load, maintenance of the pressurization of the actuating-operating fluid at extend port 314 at an appropriate level above 400 psi will be required.

Of course, as rod extension progresses, there will be a pressure build-up in space 308 as the enlarged piston head 271 and seal 286 move to the right as seen in FIG. 10 and, when this pressure build-up exceeds the setting of pressure relief valve 312 in connector passage 310, the former will open to permit the return of the pressurized fluid from space 308 into piston volume 304. Should relief valve 312 fail, safety fuse or blowout plug 318 would open with resultant de-pressurization of the apparatus 240 and immediate return thereof to the locked condition.

Once the rod end 282 has reached the desired partially or fully extended position thereof, as the case may be, it will be clear that simple de-pressurization of the actuating-operating fluid through extend port 314 below the unlock level will result in the immediate re-locking of the apparatus 240, again as heretofore described, in the said desired position.

For subsequent retraction of the rod end 282, and with all of the heretofore described apparatus volumes or spaces remaining filled with the essentially de-pressurized actuating-operating fluid, it will be understood that fluid pressurization through retract port 316 to the apparatus unlock level, with extend port 314 valved open and flow control device 315 operable to meter fluid therethrough at a predetermined, controlled pressure, will result in the unlocking of the apparatus, as heretofore described, again by pressure communication through spaces 308, 306 and 104 to and through the liner 296, and the immediately following movement of the rod-connector-piston assembly to the left as seen in FIG. 10 attendant the action of the pressurized fluid against the annular retract area provided by the enlarged piston head 271 and the piston seal 286. As this movement occurs, the fluid in the now decreasing volume between the separated piston 270 and face 322 of end cap 246 will simply be expelled by pumping through the extend port 314 and flow control device 315, with connector passage 298 acting as a pressure relief means in the event of clogging of port 314, or failure of its associated valving, to prevent excessive pressure build-up in that decreasing volume. Of course, the speed of retraction will be limited by the setting of flow control device 315 which operates on a metering out principle to maintain sufficient pressure within the apparatus 240 to in turn maintain the same unlocked. In the given 8:1 area ratio and 3200 psi unlock pressure example, flow control device 315 would be operable to maintain 400 psi in piston space 304. Again, blowout fuse 318 will function to, in any event, prevent excessive pressure build-up in annular volume 308 and its communicated apparatus volumes. Thus, the apparatus 240 remains fail-safe under all operational conditions.

Once the rod end 282 has reached the desired, relatively retracted position thereof, it will be clear that simple de-pressurization of the operating-actuating fluid through retract port 316, with virtually concomitant closure of extend port 314 to prevent further fluid flow from the apparatus 240 and insure that the same remains essentially fluid-filled, will result in the re-locking of the apparatus in that position by the re-establishment of the sleeve-liner-rod interference fits as heretofore described.

Of additionally significant advantage with regard to the apparatus 240 of FIG. 10 is that fact that the liner 82 is disposed as described between the outside diameter of piston 270 and the inside diameter of the cylinder barrel or sleeve element 242. This configuration, which may be termed a "piston lock," functions to provide the shortest possible length for the apparatus locking section—or, as seen from a different perspective, the maximum effective locking area per unit length of the apparatus 240—since the locking action is applied to the largest diametral elements of the apparatus. As a result, particularly compact apparatus of the type described, with attendant particularly high resistance to side loading, are provided without sacrifice in the locking capability of those apparatus.

Manufacture of the hereindisclosed apparatus is effected in substantially the same manner as that illustrated and described in detail with reference to FIGS. 11 and 12 of U.S. Pat. No. 3,150,571 and thus need not be repeated in detail. In this instance, however, it may be understood that the respective sleeve and liner elements would be assembled as a unit, through sleeve element expansion and use of the assembly mandrel, as described in U.S. Pat. No. 3,150,571, around the rod element.

Representative, although by no means limitative, preferred applications of apparatus configured and operable as heretofore described in accordance with the teachings of applicants' invention are as follows:

The locking and bearing apparatus 20 of FIG. 1 are readily utilizable in conjunction with a hydraulic press through the affixation of the sleeve element 22 to the stationary press structure and the attachment of the rod end 78 to, for example, a moveable platen to enable the locking of the latter in any one of a virtually infinite range of linear and/or angular positions relative to the former.

The locking and bearing apparatus 170 of FIG. 8 are readily utilizable in conjunction with a rotary hydraulic actuator through the fixed positioning of the sleeve element 22 relative to the stationary actuator structure and the attachment of shaft 178 to the rotatable actuator element, thereby enabling the locking of the latter in any one of a virtually infinite range of angular positions relative to the former.

The actuating, locking and bearing apparatus 190 of FIG. 9 are readily utilizable in conjunction with a rock drilling machine through the affixation of the sleeve element 22 to the stationary drilling machine structure and the attachment of rod end 78 to a tiltable, extendable and retractable drill boom, thereby enabling selective movement and locking of the latter throughout a virtually infinite range of linear and/or angular positions relative to the former.

The actuating, locking and bearing apparatus 240 of FIG. 10 are readily utilizable in conjunction with outrigger jacks on a high capacity hydraulic crane through the affixation of the sleeve element 242, as by use of mounting shaft 326, to the crane chassis and the attachment of rod end 78 to the jack pads thereby enabling jacking and levelling of the crane relative to its support structure throughout a virtually infinite range of crane positions. In such use, an outer tube or cover, not shown, may be secured around cylinder element 242 to provide an appropriate surface for the attachment of mounting brackets or the like, and to further protect the apparatus 240 from the environment.

The significant advantages provided by the best mode applications of the teachings of applicants' invention as heretofore illustrated and escribed include the following:

(a) The interposition of the liner between the respective sleeve and rod elements eliminates the need for grooving of the sleeve, with attendant formation of areas of stress concentration therein, to enable the requisite operating fluid flow between the rod and the sleeve. As a result, the strength and operational life of the sleeve are materially increased, while the cost of manufacture thereof is materially decreased.

(b) The interposition of the liner between the respective sleeve and rod elements enables the use of the apparatus as a readily and precisely controllable and programmable braking or decceleration device without damage to the rod or sleeve through use of readily expendable and replaceable liner materials which are less hard than either of the sleeve or rod materials.

(c) The use of the liner as above completely eliminates sleeve-rod surface contact whereby sleeve-rod wear is also eliminated with attendant material increase in operational life.

(d) The use of the liner as above enables the shifting of all of the final machining operations essentially to the sleeve, as opposed to both the rod and sleeve as heretofore required, since the liner can accept and function with a rod which is slightly "out" of tolerance. As a result, the overall cost of manufacture is further materially decreased.

(e) Machining of the operating fluid grooves is simplified and rendered materially less costly since the "softer" material of the liner is significantly more readily machinable than would be thc "harder" material of the sleeve.

(f) Repair and/or overhaul of the apparatus are greatly simplified and rendered relatively inexpensive in that, in most instances, replacement of the liner will function to totally accomplish the same. In addition, repair and/or overhaul inventories, and attendant carrying charges, are greatly reduced because the same can essentially be limited to a supply of relatively standard, and readily shippable, liner segments. Also, in those instances wherein repair and/or overhaul require more than simple liner replacement, it will be clear that the same is no longer limited to the rod, but rather, may be made to either or both of the rod and sleeve as, for example, by appropriate plating of the relevant surfaces.

(g) The interposition as above of the liner between the sleeve and rod elements greatly increases the range of materials which can be employed in the manufacture of those elements and, as a result, greatly increases the range of operating fluids and operating temperatures which can be employed therewith, thereby combining to greatly increase the range of useful applications to which the apparatus can be put. This range of materials for the rod would include any appropriately strong metal such as steel, stainless steel or aluminum, and a wide variety of appropriately strong plastic materials such as molded or fibreglass wound compositions, or boron. The metals could be heat treated or surface hardened or, alternatively, chrome electroless or nickel plated. The range of materials for the sleeve would again include any appropriately strong metal having, in addition, an appropriate modulus of elasticity, such as steel, stainless steel, or aluminum; or similarly characterized plastics such as fibre wound or fibreglass reinforced tubing, glass wound and cross-hatched epoxies, or materials composities. For apparatus use attendant controlled deceleration as described hereinabove wherein high thermal conductivity and resistance to surface wear are likely to be required of the liner material, appropriately heat treated steel or bronze would be particularly qualified. High operational temperature applications of the apparatus could also dictate the use of ceramic liner materials. Representative operating fluids would include a wide range of petroleum, water or synthetic based hydraulic fluids, and gases such as nitrogen or air. Although apparatus operating pressures can vary widely depending upon the application to which the apparatus are put, the 3200 psi operating pressure as set forth hereinabove by way of example with regard to the apparatus 240 of FIG. 10 is a representative operating pressure.

The major advantages provided as described in detail hereinabove by the new and improved basic structural configuration and manner of operation of the apparatus 240 of FIG. 10, in addition to and independent to those provided as described by the incorporation of the liner 82 therein, can, in certain instances, warrant the fabrication of the apparatus 240 without the liner in further accordance with the teachings of our invention. In such instances, the respective external diameter of the piston 270 and the internal diameter of the sleeve element 244 would be carefully predetermined to create an interference fit directly therebetween in the manner illustrated and described in detail in U.S. Pat. No. 3,150,571. Under these circumstances, appropriate operating fluid grooves would be formed, for example, in the inner surface of the sleeve element 244 as illustrated and described in U.S. Pat. No. 3,150,571, and these grooves would, of course, communicate freely with annular spaces 308 and 306 to provide for the flow of the operating fluid to the sleeve element to expand the same within the elastic limit thereof and release the sleeve element-piston interference fit, and thus the apparatus lock, upon the pressurization of the operating fluid to a sufficient level.

Various changes may be made in the hereindisclosed embodiments of our invention without departing from the spirit and scope thereof as defined in the appended claims.

What is claimed is:

1. In locking, bearing and actuating apparatus which include actuating cylinder means, double acting actuating piston means operativley disposed within said actuating cylinder means and dividing the same into first and second cylinder spaces, pressure-responsive locking means operatively associated with said actuating cylinder and piston means and operable to lock the same together and prevent relative movement therebetween, and means to pressurize said locking means to a level sufficient to release said lock, the improvements comprising, said actuating piston means comprising piston faces of different effective areas with the larger of said piston faces being operatively associated with said first cylinder space, and the smaller of said piston facs being operativley associated with said second cylinder space, means to introduce pressurized fluid into said first and second cylinder spaces, respectively, said second cylinder space being in pressurized fluid flow communication with said pressure-responsive locking means, pressurized fluid transfer passage means independent of said pressurized fluid introduction means and operatively connecting said first and second cylinder spaces, means operatively associated with said pressurized fluid transfer passage means and permitting pressurized fluid flow therethrough only from said first cylinder space to said second cylinder space, and means preventing direct pressurized fluid flow communication between said first cylinder space and said pressure-responsive locking means whereby, the introduction to said first cylinder space of fluid pressurized to a level sufficient to effect initial movement of said piston into said second cylinder space but not sufficient to fully release said pressure-responsive locking means, and the concomitant flow of said pressurized fluid from said first cylinder space to said second cylinder space through said pressurized fluid transfer means, will be effective to further pressurize said fluid in said second cylinder space to a level sufficient to fully release said pressure-responsive locking means for continued movement of said piston into said second cylinder space.

2. In apparatus as in claim 1 wherein, said locking means comprise an intereference fit between said actuating cylinder and piston means, and wherein said fluid, when pressurized to said level, is effective to expand said actuating cylinder means within the elastic limit thereof to an extent sufficient to release said intereference fit and the lock between said actuating cylinder and piston means.

3. In locking, bearing and actuating apparatus as in claim 1 further comprising, pressurized fluid relief passage means operatively connecting said second cylinder space and said first cylinder space, and pressure responsive means operatively associated with said pressurized fluid relief passage means and permitting pressurized fluid flow therethrough only from said second cylinder space to said first cylinder space upon the pressurization of said fluid to a predetermined level in said second cylinder space whereby, the pressurization of said fluid in said second cylinder space above said predetermined level upon the movement of said piston thereinto will be prevented by pressurized fluid flow through said relief passage means from said second cylinder space to said first cylinder space.

4. In locking, bearing and actuating apparatus as in claim 1 wherein said actuating cylinder and actuating piston are relatively dimensioned to provide an operating space therebetween is pressurized fluid flow communication with said second cylinder space, and said apparatus include means restricting said operating space and said second cylinder space against the loss of pressurized fluid therefrom, the further improvement comprising, said pressure-responsive locking means comprising, an intermediate element disposed in said operating space and including fluid passages formed therein in communication with said operating space for pressurized fluid distribution through said operating space, said intermediate element being dimensioned relative to said operating space to form interference fits with said actuating cylinder and said actuating piston to lock the same together and prevent relative movement therebetween, said actuating cylinder being expandable within the elastic limit thereof by pressurized fluid in said operating space to release said inteference fits whereby, the introduction to said operating space from said second cylinder space of fluid pressurized to a level effective to exapnd said actuating cylinder within the elastic limit thereof to an extent sufficient to release said interference fits will be operable to release the lock between said actuating cylinder and said actuating piston and enable relative movement therebetween, and whereby the subsequent depressurization of said fluid below said level will be operable to reinstitute said interference fits and re-lock said actuating cylinder and said actuating piston against relative movement.

* * * * *